US012253077B2

(12) United States Patent
Nettesheim

(10) Patent No.: US 12,253,077 B2
(45) Date of Patent: Mar. 18, 2025

(54) TIGHTENING DEVICE FOR A DEVICE FOR CONVEYING FLUID AND A DEVICE FOR CONVEYING FLUID

(71) Applicant: PSG GERMANY GMBH, Duisburg (DE)

(72) Inventor: Simon Nettesheim, Krefeld (DE)

(73) Assignee: PSG Germany GmbH, Duisburg (DE)

( * ) Notice: Subject to any disclaimer, the term of this patent is extended or adjusted under 35 U.S.C. 154(b) by 579 days.

(21) Appl. No.: 17/525,706

(22) Filed: Nov. 12, 2021

(65) Prior Publication Data

US 2022/0145878 A1 May 12, 2022

Related U.S. Application Data

(62) Division of application No. 17/281,963, filed as application No. PCT/EP2019/077349 on Oct. 9, 2019.

(30) Foreign Application Priority Data

Oct. 11, 2018 (DE) ..... 10 2018 008 037.5

(51) Int. Cl.
*F04B 53/16* (2006.01)
*F04B 43/02* (2006.01)

(52) U.S. Cl.
CPC ..... *F04B 53/16* (2013.01); *F04B 43/02* (2013.01)

(58) Field of Classification Search
CPC ..... F04B 43/02; F04B 43/021; F04B 43/023; F04B 43/025; F04B 43/026; F04B 43/028
See application file for complete search history.

(56) References Cited

U.S. PATENT DOCUMENTS 3,687,580 A 8/1972 Griffiths
4,573,885 A 3/1986 Petersen
(Continued)

FOREIGN PATENT DOCUMENTS

CN 108443121 A 8/2018
DE 10117531 A1 10/2002
(Continued)

OTHER PUBLICATIONS

International Preliminary Report on Patentability in International Appln. No. PCT/EP2019/077349, dated Apr. 22, 2021, 16 pages (with English Translation).
(Continued)

*Primary Examiner* — Jonathan P Masinick
(74) *Attorney, Agent, or Firm* — Fish & Richardson P.C.

(57) ABSTRACT

A tightening device for applying a preload to a fastening element, wherein the fastening element is suitable for fastening a diaphragm pump head part to a drive system for impressing movement on a diaphragm of the diaphragm pump head part in a device for conveying fluid. The tightening device has a support with support surface for supporting a bearing surface of the fastening element, wherein the support has a threaded bore through which a screw element penetrates. The screw element has a contact surface at its front end, wherein the contact surface of the screw element and the support surface of the support face opposite directions, and the distance between the contact surface of the screw element and the support surface of the support can be changed by screwing in or unscrewing the screw element.

20 Claims, 6 Drawing Sheets

(56) References Cited

U.S. PATENT DOCUMENTS

| | | | | |
|---|---|---|---|---|
| 6,000,916 | A * | 12/1999 | Martin | F04D 29/628 417/454 |
| 6,305,793 | B1 * | 10/2001 | Haines | B41J 2/17523 347/85 |
| 9,169,837 | B2 * | 10/2015 | Pascual | F04B 17/03 |
| 10,080,467 | B2 * | 9/2018 | Ciavarella | F04B 23/06 |
| 10,174,754 | B2 * | 1/2019 | Ophardt | F04B 53/16 |
| 10,190,578 | B2 * | 1/2019 | Chang | F04B 35/04 |
| 10,359,036 | B2 * | 7/2019 | Chen | F04B 53/22 |
| 11,408,415 | B2 * | 8/2022 | Brown | F04B 45/043 |
| 11,933,286 | B1 * | 3/2024 | Nettesheim | F04B 43/026 |
| D1,029,043 | S * | 5/2024 | Nettesheim | D15/7 |
| 12,116,994 | B2 * | 10/2024 | Nettesheim | F04B 53/1065 |
| 2008/0060515 | A1 * | 3/2008 | Cho | F04B 45/043 92/98 R |
| 2012/0164010 | A1 | 6/2012 | Pascual | |
| 2022/0170560 | A1 * | 6/2022 | Kodandaramaiah | F04B 43/028 |

FOREIGN PATENT DOCUMENTS

| | | | |
|---|---|---|---|
| DE | 1002015103250 | A1 | 8/2016 |
| DE | 202006020237 | U1 | 9/2017 |
| DE | 202017004425 | U1 | 9/2017 |
| EP | 1477675 | A1 | 11/2004 |
| WO | 2012088312 | A2 | 6/2012 |

OTHER PUBLICATIONS

International Search Report and Written Opinion as issued in connection with International Patent Application No. PCT PCT/EP2019007349 mailed Apr. 16, 2020.

* cited by examiner

TIGHTENING DEVICE FOR A DEVICE FOR CONVEYING FLUID AND A DEVICE FOR CONVEYING FLUID

CROSS-REFERENCE TO RELATED APPLICATIONS

This application is a divisional of co-pending U.S. patent application Ser. No. 17/281,963, filed on Apr. 9, 2021, the subject matter of which is incorporated by reference herein in its entirety for all purposes.

FIELD OF INVENTION

The invention relates to a tightening device for applying a preload to a fastening element, the fastening element being suitable for fastening a pump head part to a drive system for impressing movement on movable elements of the pump head part in a device for conveying fluid, in particular for fastening a diaphragm pump head part to a drive system for impressing movement on a diaphragm of the diaphragm pump head part. The invention further relates to a device for conveying fluid with a pump head part and a drive system for impressing movement on movable elements of the pump head part, in particular with a diaphragm pump head part and a drive system for impressing movement on a diaphragm of the diaphragm pump head part and a bolt connected to a housing of the drive system, which penetrates a through-hole through a housing of the pump head part, in particular the diaphragm pump head part. The invention also relates to a method for generating a preload on the bolts of such a device.

BACKGROUND

Diaphragm pumps having a diaphragm pump head are used in particular in the fields of chemistry, pharmaceuticals, and biotechnology, in which the media to be conveyed are sometimes very expensive, so sterile operating conditions are often considered necessary, which means that contamination of the media to be pumped must be prevented.

Diaphragm pumps are established that have a pump head that is fixed to the drive system, in particular to the drive system housing and the drive system elements. Since the pump head is fixed to the other elements of the diaphragm pump, the pump head must be completely cleaned after each cycle of a medium to be conveyed or pumped. This means that the pump head must be completely drained and sterilized before a new or different medium is conveyed. This is time consuming.

A replaceable pump head for a diaphragm pump is established by DE 20 2017 004 425 U1, in which the pump head is designed and replaceable separately from a drive system and forms a hermetically sealed unit. The pump head is detachably fastened to the drive system by means of multiple holding clamps or mounting straps, preferably two holding clamps. This quick-release mechanism presents time savings upon mounting of the replaceable pump head on the other pump elements, in particular the drive system. A functionally reliable mounting of the pump heads is possible by means of the replaceable pump head established by DE 20 2017 004 425 U1.

DE 20 2006 020 237 U1 exhibits a diaphragm pump that consists of a pump head with multiple pump chambers connected to a drive system, each pump chamber being sealed off from a drive system chamber by means of a pump diaphragm. The pump head is divided into a replaceable diaphragm head part, and a drive system head part that is fixed to the drive system. Through the division of the replaceable diaphragm head part and the drive system head part, the diaphragm head part that comes into contact with the media to be pumped can simply be detached from the diaphragm pump and, for example, cleaned and sterilized with supply lines before use. The diaphragm head part or its diaphragm housing part and the drive system head part or the drive system chamber part are usually fastened to each other with bolts in order to secure the corresponding seal. This usually requires the use of a tool that engages the bolts. In addition, it must be ensured that the torque of the bolts is neither under nor over the specific target torque.

SUMMARY

The object of the invention is to create a simple, structured way of fastening, in which the partially inherent inadequacies and/or difficulties are reduced.

This object is achieved by the subject matter of the independent claims. Advantageous embodiments are described in the dependent claims and the following description.

The invention is based on the basic idea of providing a tightening device for applying a preload to a fastening element, the fastening element being suitable for fastening a pump head part to a drive system for impressing movement on movable elements of the pump head part in a device for conveying fluid, in particular for fastening a diaphragm pump head part to a drive system for impressing movement on a diaphragm of the diaphragm pump head part, wherein the fastening element has a bearing surface. Fastening elements of this type are usually bolts with an undercut on which the bearing surface is executed, or with a protruding head on which the bearing surface is executed. The tightening device designed for a device equipped in this way provides, according to the basic idea of the invention, a support surface for supporting the bearing surface of the fastening element and a contact surface, the contact surface and the support surface facing opposite directions and the distance between the contact surface and the support surface being adjustable. If the distance is increased and the contact surface rests, for example, on the pump head, particularly preferably on the diaphragm pump head or on an element that rests on the pump head, in particular on the diaphragm pump head, for example on an interposed pressure plate, the increase in the distance leads to the generation of a force that pushes the bearing surface of the fastening element away from the element on which the contact surface rests. This preloads the fastening element.

The invention is explained in more detail below on the basis of a diaphragm pump, without thereby restricting the object of the invention to a diaphragm pump. The embodiments according to the invention can also be applied to other pumps.

To implement this basic idea, the invention stipulates that the tightening device be equipped with a support with a support surface for supporting the bearing surface of the fastening element, the support having a threaded bore through which a screw element penetrates. The screw element has a contact surface at its front end, wherein the contact surface of the screw element and the support surface of the support face opposite directions, and the distance between the contact surface of the screw element and the support surface of the support can be changed by screwing in or unscrewing the screw element.

The screw element can have a threaded pin. The screw element can have a head at the rear end, which is opposite the front end with the contact surface. The head of the screw element can have a diameter that is larger than the diameter of the threaded pin. The head is not necessarily round in cross section, but rather can also be polygonal.

The screw element has external thread for engaging the internal thread of the threaded bore of the support. The external thread is in particular a fine thread. This makes it possible to reduce the force required to turn the screw element; in addition, particularly good self-locking can be achieved with a fine thread.

In a preferred embodiment, the contact surface formed on the front end of the screw element is flat. In a preferred embodiment, the flat contact surface lies in a plane that is perpendicular to the longitudinal axis of the screw element. The contact surface of the screw element is part of a mechanism with which a preload is to be generated, namely by changing the distance between the contact surface of the screw element and the support surface of the support. This means that compressive forces are introduced from the screw element into the element against which the contact surface of the screw element rests. If the contact surface is flat, this can prevent or reduce deformation of the element on which the contact surface rests. Such deformation could occur, for example, if the contact surface were the outer surface of a cone. The contact surface being designed as the outer surface of a cone, which is not excluded, is possible in another embodiment of the invention—possibly for other motivational bases.

The contact surface of the screw element and the support surface of the support face opposite directions. In a preferred embodiment, the contact surface of the screw element is flat and the support surface of the support is flat, the flat contact surface of the screw element lying in a plane which is parallel to a plane in which the flat support surface of the support lies. This type of parallel alignment of the contact surface and the support surface makes it possible, by changing the distance between the contact surface and the support surface, to generate a preload in a predetermined direction, namely perpendicular to the planes. Embodiments are indeed also conceivable in which a flat contact surface of the screw element does not run parallel, but rather at an angle to a flat support surface of the support. It is also conceivable that the contact surface of the screw element is not flat, but the support surface of the support is flat. It is also conceivable that the contact surface of the screw element is flat, but the support surface of the support is not flat. It is also conceivable that the contact surface of the screw element is spherical.

The distance between the contact surface of the screw element and the support surface of the support can be changed by screwing in or unscrewing the screw element. In a preferred embodiment, the distance between the contact surface of the screw element and the support surface of the support is increased by screwing in the screw element and is reduced by unscrewing it. In particular in the embodiments in which the screw element has a head, screwing in the screw element is understood to indicate a screwing motion of the screw element that brings the head closer to the threaded hole.

In a preferred embodiment, the support is designed as a plate, particularly preferably as a round disk or as a plate-shaped element. In a preferred embodiment, the threaded hole is provided at the center point of the support. In a preferred embodiment, the support surface is peripheral to the center point of the support.

In a preferred embodiment, the support has multiple support surfaces, each support surface being provided for supporting a bearing surface of one of multiple fastening elements. In the case of a design with multiple support surfaces, a preferred embodiment stipulates that the support surfaces be arranged at the same distance from the center point of the support. The support surfaces are particularly preferably arranged equidistant from one another in a ring around the center point of the support.

The through-hole in the support can in particular be positioned centrally in the support; particularly preferably, the through-hole is oriented parallel to the longitudinal axis of the diaphragm pump head part; particularly preferably, the through-hole coincides with the longitudinal axis of the diaphragm pump head part. It is not excluded that more than one through-hole is provided on the support. Preferably, however, only one screw element is used, which interacts with the internal thread of a through-hole of the support in order to exert a force on the diaphragm pump head part in the direction of the drive system. However, there can also be two or more through-holes. For each of the two, three, or more through-holes, an externally threaded screw element that interacts with the internal thread of the respective through-hole can be provided.

In a preferred embodiment, a pressure plate is provided. This is suitable for coming into contact with the diaphragm pump head section. The contact surface of the screw element rests against the pressure plate. In a preferred embodiment, the pressure plate can be situated between the diaphragm pump head part and the support. In this way, an element in the form of the pressure plate can be provided, which can transmit a force over a large area. A distribution of the translational force from the end of the screw element is possible over the entire surface of the pressure plate. The pressure plate preferably has an end face whose dimensions in cross section essentially correspond to the end face of the diaphragm pump head part. The force acting on the pressure element from the end of the screw element can be distributed over the entire surface of the pressure plate.

In an alternative, likewise preferred embodiment, the contact surface of the screw element can be brought into direct contact with the diaphragm pump head part without a pressure plate being interposed.

In a preferred embodiment, the support has a recess that can accommodate the pressure plate, especially in operating situations in which the screw element is screwed out of the threaded hole so that the distance between the contact surface and the support surface is reduced.

In a preferred embodiment, a plate-shaped handling element connected to the screw element is provided, whereby a rotation of the handling element rotates the screw element. The screw element can be rotated together with the handling element. A simplification of the configuration can thereby be achieved in that the screw element can be manipulated by means of a handling element. In particular, this makes it possible to forgo specially designed tools that can engage with the heads of fastening elements, in particular bolts. A plate-shaped handling element can form a wheel that can be rotated by means of an operator's hand, whereby a rotary motion that is converted into the linear movement of screwing in or unscrewing the screw element can be applied in a simplified manner.

The term "plate-shaped" in the sense of the description comprises an element with a cross section that is polygonal, elliptical, circular, or a mixed form of the aforementioned shapes, which has a small extension in depth or height relative to the cross section (i.e. perpendicular to the cross section). The term "plate-shaped" does not exclude structuring in the edge area, by means of which the manipulation of the handling element can be improved, in particular upon rotating it about a longitudinal axis transverse to the cross section, very particularly preferably to the central axis of the cross section.

The handling element can essentially have a contour of the cross section that corresponds to the contour of the diaphragm pump head part. In particular, the handling element can have an outer dimension of the cross section that corresponds to the outer dimension of the diaphragm pump head part. In particular, the handling element is rotationally symmetrical with regard to its cross section, which simplifies manipulation. In particular, the screw element can be rotatably mounted on the handling element at the center point, so that the external thread of the screw element extends in particular in a direction parallel to the longitudinal axis of the diaphragm pump head part. The center point of the handling element is very particularly preferably oriented along the longitudinal axis of the diaphragm pump head part. A symmetrical arrangement can in particular prevent a twisted and/or angled, (i.e. essentially undesirable) transmission of force.

In a preferred embodiment, the screw element and the handling element form a concertedly manageable unit, whereby handling and/or assembly is simplified. In the sense of the description, a concertedly manageable unit is understood in particular to mean that the screw element is present on the handling element in a captive manner. If the handling element is gripped, the screw element is likewise oriented on the handling element. The screw element can be located in a receptacle of the handling element.

The head of the screw element can be located in a depression of the handling element, which can in particular be designed in the middle, wherein the screw element can be secured by means of a retaining element designed as an annular element, which can rest circumferentially both on the head of the screw element and on the edge of the depression.

In a preferred embodiment, a slip clutch is formed between the screw element and the handling element. The slip clutch can in particular be exercised or activated when a force that is impressed by the screw element on the diaphragm pump housing is exceeded. The slip clutch provided between the screw element and the handling element can limit the torque that can be applied to the screw element. In this way, the compressive force that can be applied to the diaphragm pump housing can be set to a certain level in such a way that the tactile or haptic and/or acoustic (click) feedback from the slip clutch indicates to the operator not only that the diaphragm pump housing is attached to the drive system with sufficient compressive force, but also that the compressive force has not been exceeded. The slip clutch is functionally equitable to a torque limit that acts on the screw element. The torque can correspond to a corresponding compressive force to be set, so that it can be ensured that when a predetermined torque is reached (and the slip clutch or torque limiter is activated), there is sufficient compressive force on the diaphragm pump head part in the direction of the drive system. In particular, a slip clutch can be formed between the screw element and the handling element only in one direction. While a slip clutch is provided for the screw element or the handling element in one direction of rotation, a direct transmission of force can be achieved in the other direction of rotation—without a slip clutch or torque limiter.

In a preferred embodiment, the screw element is supported on a circumferential surface of the handling element. This is particularly preferably an inwardly pointing circumferential surface of a protruding, circumferential edge of the handling element. In this way, a particularly simple slip clutch can be achieved. In particular, the screw element can be supported with its head on the circumferential side of an annular element, preferably the retaining element by which the screw element is secured on the handling element. It can be intended, for example, that the support be released or the slip clutch respond when a certain torque is reached. In this respect, the transmission of force between the handling element and the screw element can be released by removing the support. If the annular element is designed as a retaining element, multiple functions can be achieved by means of one element.

In a preferred embodiment, at least one pressure element is provided between the screw element and the handling element, the pressure element interacting with a profile of the handling element or annular element, particularly with the retaining element. Depending on the design of the profile, a transmission of force can be set, and/or the torque can be limited. Different types of profiles, in particular for the movement to apply a compressive force to the diaphragm pump head part or to reduce the force exerted on the diaphragm pump head part, in particular for releasing the diaphragm pump head part from the drive system, can be selected.

In a preferred embodiment, multiple pressure elements are provided. The pressure elements can serve to support the screw element on the handling element. A symmetrical arrangement of the pressure elements around the screw element, in particular around the head of the screw element, can be advantageous. In particular, more than one pressure element can be arranged circumferentially around the head of the screw element at equidistant angles. In a preferred embodiment, all pressure elements are configured identically or similarly, so that the same pressure is transmitted between the head of the screw element and the profile by means of the pressure elements. Embodiments are also conceivable in which the pressure elements do not follow the circumferential direction of the head of the screw element, but rather point in the axial direction. Such pressure elements can interact with a profile that is executed on the surface of a plate, for example a sawtooth profile formed in the shape of a ring on the surface of a plate.

The profile can in particular be designed as an inner contour of the retaining element. The profile can be selected and/or exchanged depending on the required compressive force on the diaphragm pump head part. In particular, the profile can be temporarily fastened to the handling element. It can also be designed additionally or alternatively to exchange this or the pressure element(s) in order, for example, to adjust the spring force with which the screw element is supported on the circumferential side.

This or the pressure element(s) can comprise a sleeve, a spring, and an engagement piece, which can preferably be designed in the form of a pin or sphere and/or be rounded at the end for engagement with the profile. The pressure element can be located in particular in a recess in the head of the screw element for a simple configuration. The recess preferably extends transverse to the axis of rotation of the handling element, very particularly preferably perpendicular to the axis of rotation of the handling element. Preferably, two, three, four, five, six, or more pressure elements of the same type are provided at equidistant angles around the circumference of the head of the screw element.

In a preferred embodiment, the profile has at least one asymmetrically designed recess for the pressure element, whereby two different types of force transmission can be set for the transmission of force in the direction of the diaphragm pump head part (for tightening) and in the direction away from the diaphragm pump head part (for loosening). In particular, multiple recesses, preferably identical or similar, can be provided in the profile, whereby the same or a smaller number of pressure elements can be provided between the head of the screw element and the profile.

In a preferred embodiment, the profile in the direction of rotation for moving the diaphragm pump head part onto the drive system has a driver surface angled with respect to a radial line of the handling element, whereby the limitation of rotational force or the formation of a slip clutch is enabled. In particular, a rotational force limitation, or torque limitation, can be selected by the design of the angle. In particular, the angle of the driver surface is such that the driver surface in the end region, or head region, of the engagement piece lies closer to the engagement piece than at a distance from the end region, or head region, of the engagement piece.

In the sense of the description, the term "radial line" includes an axis that extends radially from the center point of the handling element, or the axis of rotation of the handling element, or of the screw element, and is transverse to the longitudinal axis of the diaphragm pump head part.

In a preferred embodiment, the profile has in the direction of rotation for moving the screw element away from the diaphragm pump head part a driver surface that is essentially parallel to a radial line of the handling element. In this way, it can be ensured that a force for releasing the fastening of the diaphragm pump head part on the drive system is possible directly, or with the highest possible transmission of force. Functionally equivalent, for a driver surface parallel to the radial line, a driver surface can be designed in such a way that the engagement piece contacts the driver surface in such a way that the head region or end region of the engagement piece is farther from the driver surface than a region of the engagement piece that is a distance from the head region or end region.

In a preferred embodiment, at least one bolt is provided that penetrates through the diaphragm pump head part along the effective direction and can be connected to the drive system and the support. It is thereby possible to use elements that are easy to manufacture and able to be constructed in a conventional manner. The diaphragm pump head part only needs to have a number of through-holes that corresponds to the number of bolts used. The through-holes are preferably formed at the edge around the longitudinal axis of the diaphragm pump head part and extend parallel to the longitudinal axis of the diaphragm pump head part.

In a preferred embodiment, multiple bolts are provided that can be temporarily fastened at the edge with the drive system head part or the drive system chamber section. In particular, more than two, very particularly preferably more than three bolts are provided, which can be arranged in particular at equidistant angles around the drive system head part or the drive system chamber section in order to be able to evenly distribute the forces incurred from the support.

The bolts can also penetrate the pressure plate, elongated holes preferably being provided for this purpose, which allow for a certain tolerance in the positioning of the pressure plate on the bolt or bolts.

In a preferred embodiment, the support has a plate-shaped component that is also penetrated by the bolt or bolts. The support can be temporarily fastened to the bolt or bolts by means of a bayonet-type connection. This makes it possible to form a temporary, secure connection between the support and the bolt or bolts without a tool. The support can already be fixed on the bolt in such a way that there is already an initial compressive force on the diaphragm pump head part in the direction of the drive system. A bayonet-type connection requires little maintenance and is simple to design. However, a connection other than a bayonet-type connection that securely fixes the support on the bolt or bolts is also possible. The formation of a plate-shaped support provides good stability with a corresponding connection of the bolt or bolts. In particular, the cross section of the support can essentially correspond to the cross section of the diaphragm pump head part.

The fastening of the diaphragm pump head part to the drive system can be reduced to the rotation of a screw element, thanks to the invention. The screw element can exert a compressive force on the diaphragm pump head part in the direction of the drive system. The fastening of the diaphragm pump head part to the drive system can thus be reduced to consideration of the single screw element. A slight possible extension along the longitudinal axis through the provision of the support and the screw element is generally irrelevant for the application, because even with devices that have been customary up to now, access to the front was necessary for a possible screw connection, and space is therefore available in this direction.

The device for pumping fluid proposed according to the invention has a diaphragm pump head part, a drive system for impressing movement on a diaphragm of the diaphragm pump head part, and a bolt connected to a housing of the drive system, which penetrates a through-hole through a housing of the diaphragm pump head part. The device according to the invention has a tightening device according to the invention, wherein the bolt has a bearing surface that is supported by the support surface of the support of the tightening device.

In the sense of the description, the term "diaphragm pump head part" includes a pump head or a part or section of a pump head, which is preferably designed to be separate from the other elements, in particular the drive system, very particularly preferably from the drive system unit and the drive system housing and can therefore be individually replaceable. The diaphragm pump head part can in particular be manageable as a unit. The diaphragm pump head part can essentially have a diaphragm housing section, a valve plate situated between the diaphragm housing section and a diaphragm housing cover, a diaphragm plate, and a swash plate. The diaphragm pump head part can have an inlet for the medium to be pumped into the pump head and an outlet from the pump head for the fluid to be conveyed/pumped, the inlet and outlet preferably being provided on or in the diaphragm housing section. The diaphragm plate can exhibit the pump diaphragms of the pump chambers. The swash plate can be connected via a ball bearing to a pin that is angled relative to a longitudinal axis of a drive shaft connected to the drive. A drive system head part connected to the drive system can exhibit the drive shaft with the ball bearing situated on the drive pin.

The swash plate can form an interface between the two pump head parts (i.e. the diaphragm pump head part and the drive system head part). The diaphragm pump head part can be pressed together with the receiving bore of the swash plate relatively easily via the ball bearing attached to the pin of the drive shaft and thus connected to the drive system head part. The connection with the drive system head part can also be carried out differently, for example force-fit or by means of bolts on the swash plate.

The drive system head part can have a drive system chamber part with the drive system chamber, to which the diaphragm pump head part can be coupled. The drive system chamber part can have the pin of the drive shaft with the ball bearing for receiving the swash plate in its drive system chamber, which opens towards the drive system head part.

The mentioned division can provide the advantage that the swash plate is easily accessible for assembly. In the case of reusable systems, the swash plate or the pump diaphragms (or the diaphragm plate) as well as other parts of the diaphragm pump head part can easily be replaced.

The drive system chamber part can be positioned in front of the drive system housing via a chamber closure part. The chamber closure part can form the drive system chamber wall on the drive system side as well as a bearing for the drive shaft. The drive shaft can be supported in the chamber closure part via a double ball bearing. The chamber closure part can form the connection to the drive system housing in which the drive shaft is connected to a drive motor.

The valve plate can be located in a stepped recess of the diaphragm pump head part with lateral axial play and fixed with respect to the diaphragm housing section and the diaphragm housing cover in the axial direction by elastomeric sealing elements. Through the lateral and axial play of the valve plate with simultaneous fixation in the axial direction by elastomeric sealing elements, a kind of floating support of the valve plate between the first and second housing parts, in particular the diaphragm housing section and the diaphragm housing cover, is achieved. As a result, different expansion coefficients reliably prevent deformation of the valve plate, for example during autoclaving (i.e. when sterilizing with superheated steam).

The drive system can have a drive system chamber section with a drive system chamber that is located in front of the diaphragm housing cover. When the diaphragm pump head part is placed on the drive system head part, the swash plate located on the diaphragm pump head part is situated in the drive system chamber. The swash plate is slipped over a ball bearing that is located on a pin of a drive shaft connected to the drive. The pin is angled with respect to the longitudinal axis of the drive shaft in order to generate a wobbling motion of the swash plate.

The invention also provides a method for generating a preload on the bolt in a device according to the invention. In the method, in order to generate the preload, the distance between the contact surface of the screw element and the support surface of the support is changed, especially increased by screwing in or unscrewing the screw element.

The invention also provides an application for fastening a diaphragm pump head part to a drive system for impressing movement on a diaphragm of the diaphragm pump head part, in which case a support is utilized. The support is fixed essentially in a position relative to the drive system in an effective direction of the fastening. A screw element is used that penetrates through the support and with which the diaphragm pump head part can be placed onto the drive system in the form of a linear drive shaft.

If aspects relating to a device are described in the context of the description, then these aspects also apply to the described method or the described application. A transfer of the individual characteristics named for the device, the method, and the application, as well as individual designs, apply to the other two aspects in an analogous or corresponding manner.

BRIEF DESCRIPTION OF DRAWINGS

The invention is explained in more detail below with reference to drawings illustrating an example embodiment of the invention. Shown therein.

DETAILED DESCRIPTION

Figure 1:
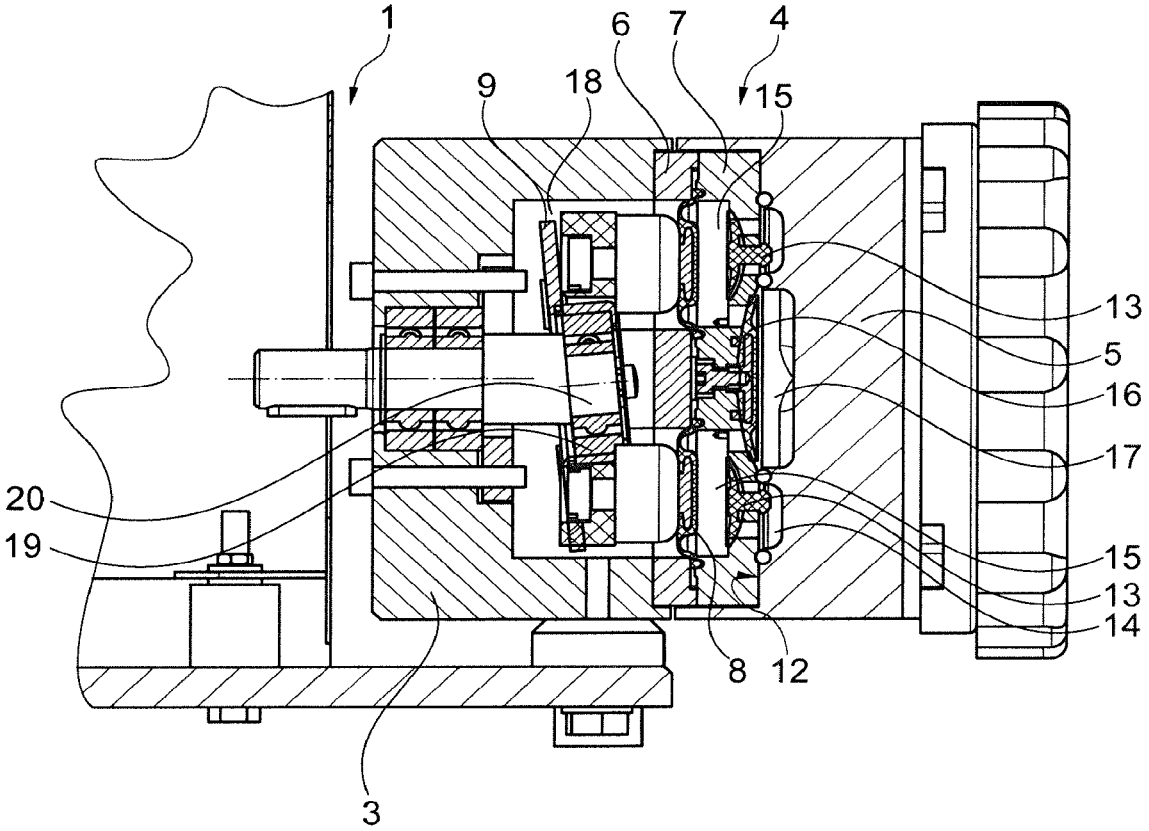
FIG. 1 a sectional view through a drive system chamber section and a diaphragm pump head part.

FIG. 1 shows a device for conveying fluid, which is designed as a diaphragm pump 1. The diaphragm pump 1 has a drive system 2, of which a drive system head part designed as a drive system chamber section 3 is shown in FIG. 1, and a diaphragm pump head part 4.

The diaphragm pump head part 4 essentially has a diaphragm housing part 5, a valve plate 7 situated between the diaphragm housing part 5 and a diaphragm housing cover 6, a diaphragm plate 8, and a swash plate 9.

Figure 2:
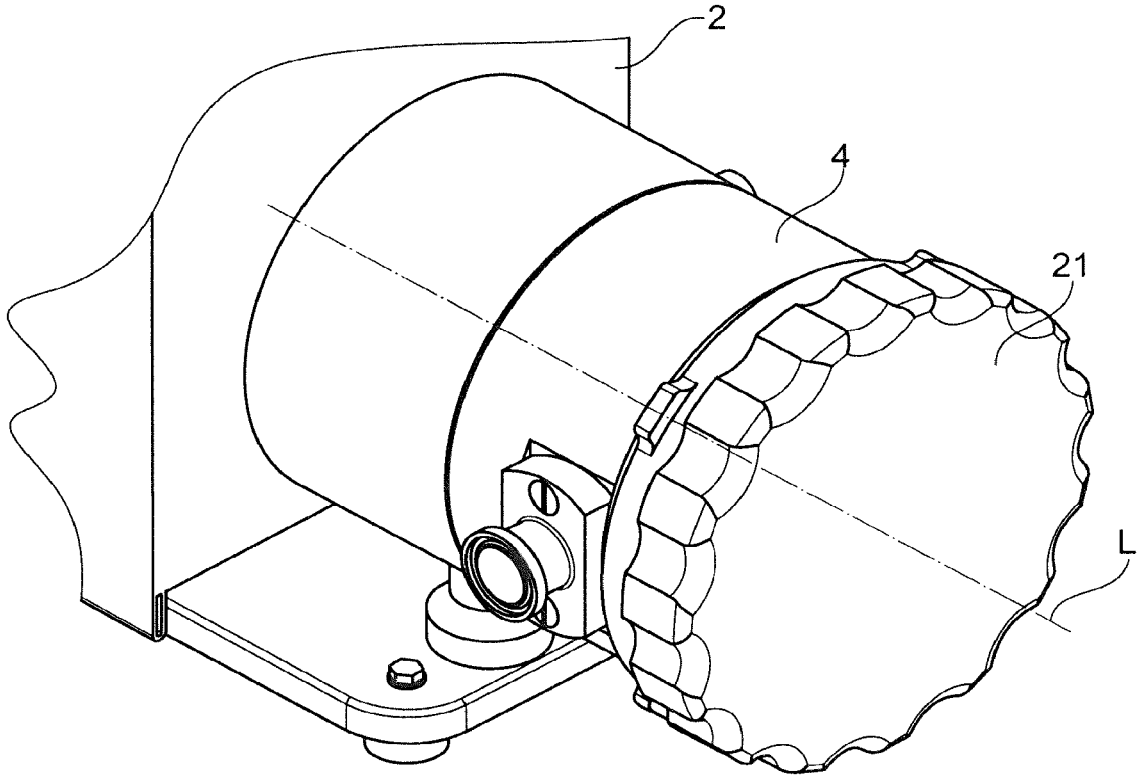
FIG. 2 a device for conveying fluid in an isometric view.
Figure 3:
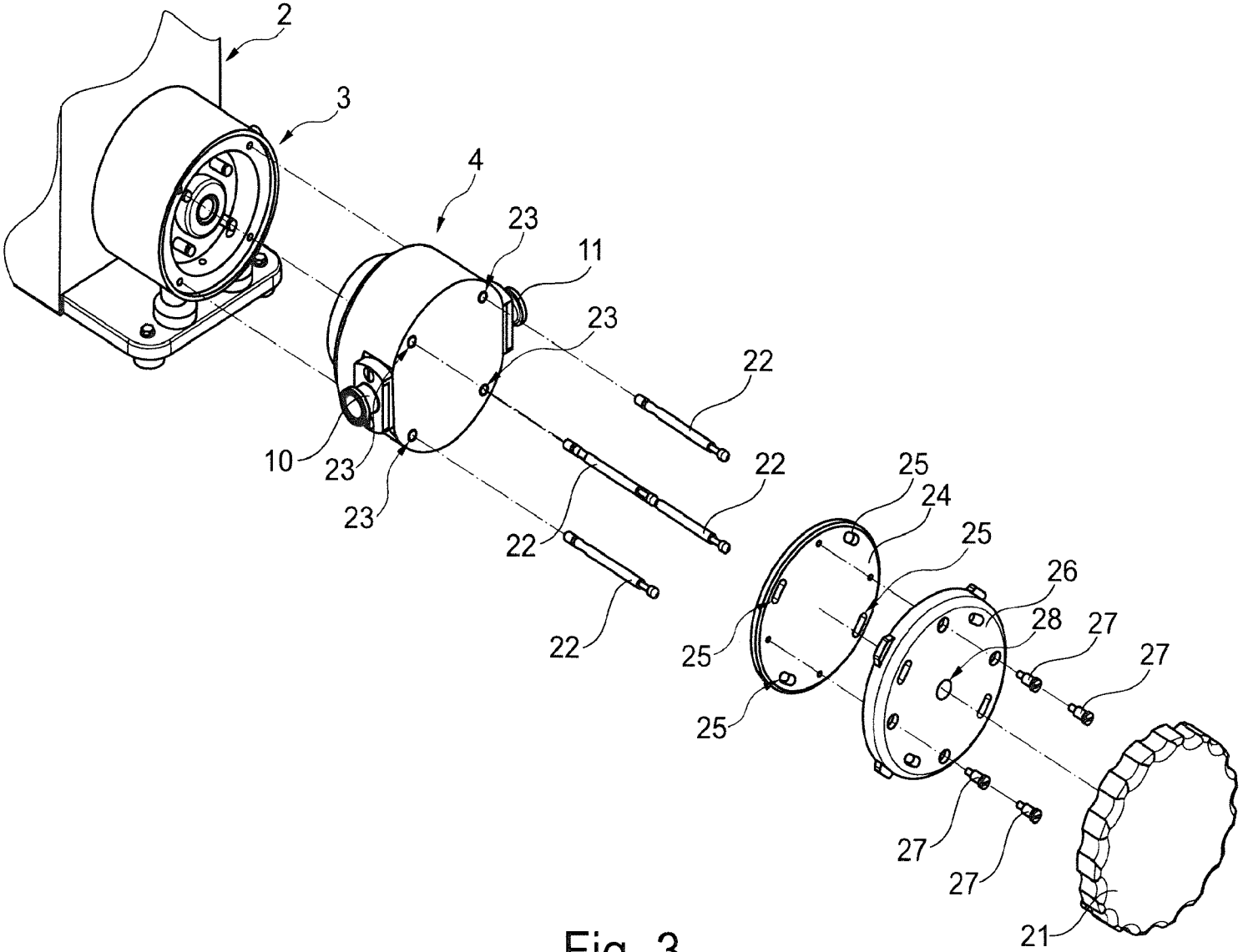
FIG. 3 the device for conveying fluid corresponding to FIG. 2 in a partially exploded view.

As can be gathered by way of example from FIGS. 2 and 3, the diaphragm housing part 5 has an inlet 10. The diaphragm housing part 5 also has an outlet 11.

Between the diaphragm housing part 5 and the diaphragm housing cover 6, the valve plate 7 is located in a stepped recess 12 of the diaphragm housing part 5.

The valve plate 7 has four inlet valves 13, the valve channels of which are connected on one side to an annular inlet chamber 14 and on the other side to pump chambers 15 covered externally by the valve plate 7. The valve plate 7 has four outlet valves 16, wherein a central outlet valve body is provided. The valve channels of the outlet valves 16 are connected on one side to a central outlet chamber 17 and on the other side to the pump chambers 15. The pump chambers 15, which are open towards the diaphragm housing cover 6, are each closed or restricted by a pump diaphragm that is designed as a section of the diaphragm plate 8. The pump diaphragms are clamped between the valve plate 7 and the diaphragm housing cover 6 and seal the respective pump chamber 15 by means of an annular bead that runs in a groove circumscribing the pump chamber 15.

The drive system head part has a drive system chamber part 3 with a drive system chamber 18, which is located in front of the diaphragm housing cover 6. When the diaphragm pump head part 4 is placed on the drive system head part, the swash plate 9 located on the diaphragm pump head part 4 is situated in the drive system chamber 18. The swash plate 9 is slipped over a ball bearing 19 that is located on a pin 20 of a drive shaft connected to the drive system 2. The pin 20 is thereby angled with respect to the longitudinal axis of the drive shaft in order to generate a wobbling motion of the swash plate 9.

FIG. 2 shows the fastening of the diaphragm pump head part 4 on the drive system in an isometric view. A handling element 21, which can be rotated about the longitudinal axis L of the diaphragm pump head part 4, is provided for fastening. The handling element 21 is profiled around the circumference.

In FIG. 3 is an exploded view of the components provided for fastening the diaphragm pump head part 4 to the drive system 2. Around the circumference of the drive system chamber section 3, bores are provided for bolts 22 that can be screwed to the drive system chamber section 3. Four bolts 22 are provided, which are temporarily fastened to the drive system chamber section 3 at the edge at equidistant angles.

The diaphragm pump head part 4 has through-holes 23 that are adapted to the outer diameter of the bolts 22 and through which the bolts 22 can be guided. The diaphragm pump head part 4 can essentially be placed on the drive system chamber section 3 along the longitudinal axis L of the diaphragm pump head part 4, the bolts 22 being guided through the corresponding through-holes 23.

A pressure plate 24 is placed on the outside of the diaphragm pump head part 4, which is spaced apart from the drive system 2, the pressure plate 24 having slotted holes 25 formed around the circumference, through which the bolts 22 can be guided. The pressure plate 24 can be placed on the four bolts 22 and moved in the direction of the diaphragm pump head part 4 along the longitudinal axis L of the diaphragm pump head part 4.

A support 26, which can also be referred to as a bayonet plate, is fastened to the bolts 22, the position of which is fixed relative to the longitudinal axis L of the diaphragm pump head part 4, or the effective direction of the fastening of the diaphragm pump head part 4 to the drive system 2. The connection between the support 26 and the bolts 22 occurs in the form of a bayonet-type connection in that the support is pushed onto the bolts 22 and rotated relative to them about the longitudinal axis L of the diaphragm pump head part 4. As a result, the head of the bolt 22 comes into contact with the bearing surface of the support 26. The bearing surface faces away from the diaphragm pump head part 4. An undercut on the head of the bolt 22, which faces the direction of the diaphragm pump head part 4, comes into contact with this bearing surface. The support 26 and the pressure plate 24 are connected to one another by means of four screws 27.

Figure 4:
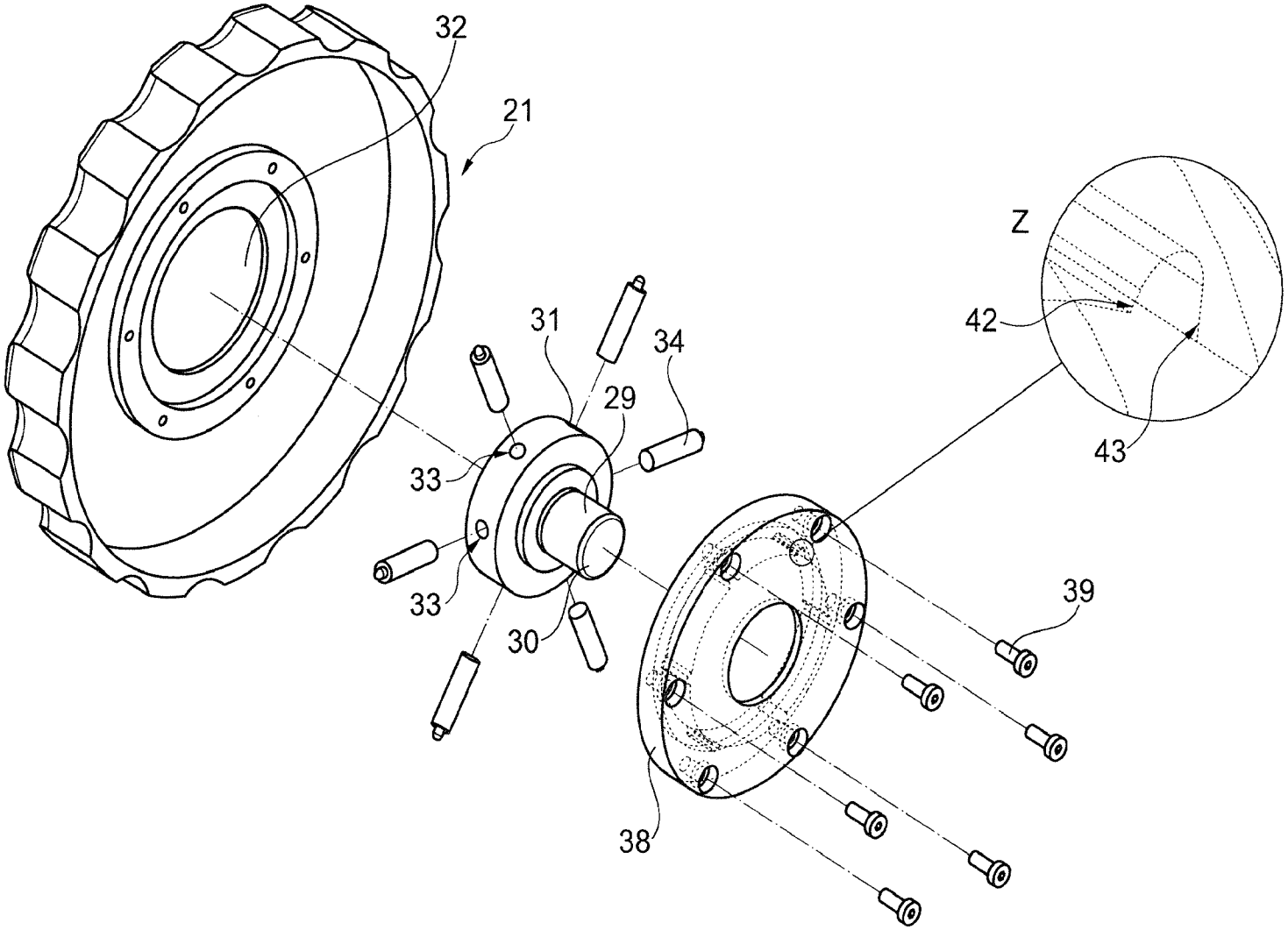
FIG. 4 an exploded view of a handling element with a screw element mounted on the handling element.

The support 26 has a central through-hole 28 with internal thread. The internal thread is matched to the external thread of a screw element 29 (FIG. 4), and the screw element 29 can penetrate the through-hole 28 and be rotated in the internal thread. By rotating the screw element 29 in the through-hole 28, a contact surface on the front end 30 of the screw element 29 directed towards the pressure plate 24 can act on the pressure plate 24. The screw element 29 is supported on the support 26 by means of the thread engagement and can press the pressure plate 24 and the diaphragm pump head part 4 in the direction of the drive system 2.

The screw element 29 is mounted centrally in the handling element 21, which can also be referred to as a handwheel. The longitudinal axis of the screw element 29 essentially coincides with the longitudinal axis L of the diaphragm pump head part 4. At the end opposite the end 30, the screw element 29 has a head 31, which is in contact with the handling element 21. A depression 32 is formed in the handling element 21, which at least partially receives the head 31. Recesses 33 are formed circumferentially around the head 31 of the screw element 29, into which the pressure elements 34 are inserted.

Figure 5:
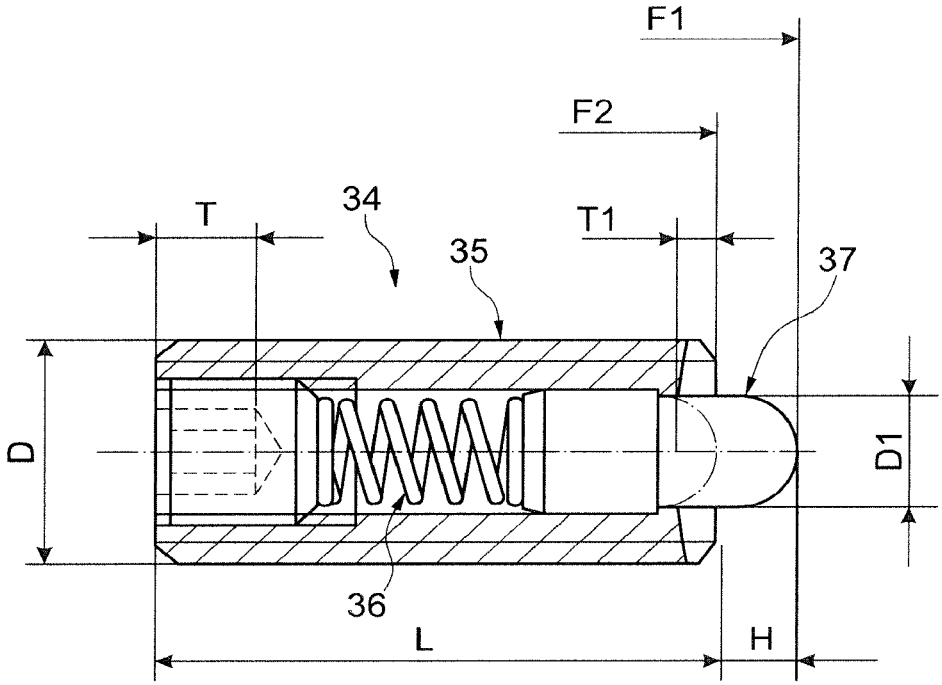
FIG. 5 a pressure element in a sectional view along its longitudinal axis.

According to FIG. 5, which shows a sectional view of the pressure elements 34, the pressure elements 34 have a sleeve 35, a spring 36, and an engagement piece 37. The screw element 29 is supported on its circumferential side by the handling element 21 via the pressure elements 34, six of which are provided at equidistant angles around the circumference of the head 31 of the screw element 29.

Figure 6:
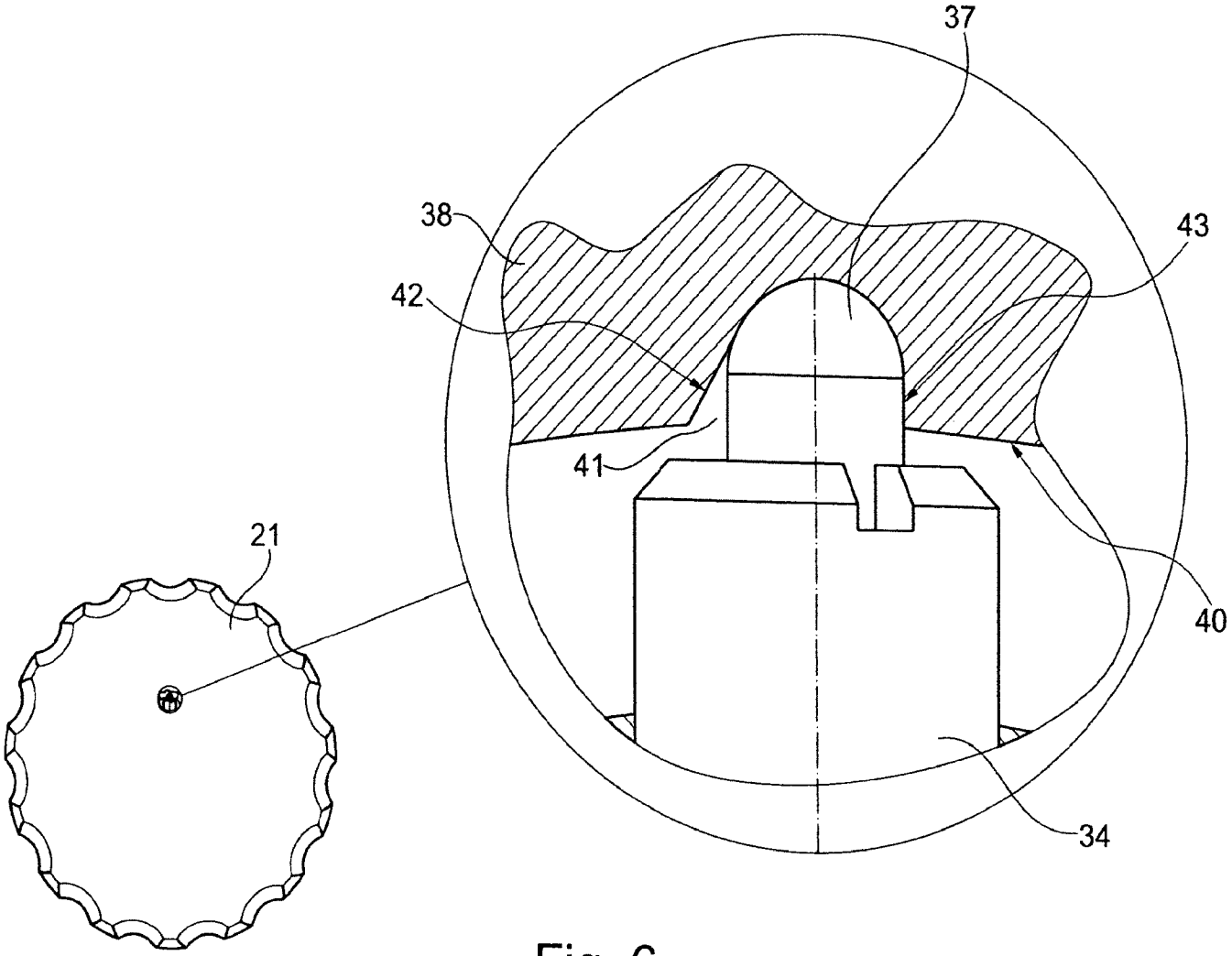
FIG. 6 a front view of the handling element with an enlarged break-out view.

A retaining element 38 is fastened to the handling element 21 by means of screws 39. The engagement pieces 37 of the pressure elements 34 are engaged with the inner contour of the retaining element 38. An inner contour in the form of a profile is formed on the retaining element 38 as shown in FIG. 6, which shows a front view of the handling element 21 with an enlarged break-out view, which is illustrated again in Detail Z in FIG. 4. The profile 40 has a recess 41 for each engagement piece 37, in which the engagement piece 37 is engaged. For each of the pressure elements 34 in FIG. 4, a recess 41 is provided in the profile 40 of the retaining element 38 at a corresponding point. The recesses 41 are designed identically.

FIG. 6 shows a different effect when rotating the handling element 21 due to the asymmetrically configured profile 40. Regarding recess 41, the profile 40 is designed asymmetrically in such a way that a driver surface 42 for rotation in the clockwise direction, as is shown schematically in FIG. 6, is angled with respect to the radial line of the handling element 21. Due to the angle, the profile 40 acts functionally like a slip clutch when rotated clockwise together with the pressure element 34. From a certain torque acting on the screw element 29, the engagement piece 37 of the pressure element 34 disengages from the recess 41 with continued rotation. The engagement piece 37 can slip out of the recess 41, which is enabled by the angled driver surface 42.

When the handling element 21 is rotated counterclockwise, the engagement piece 37 is engaged with a driver surface 43 of the profile 40, which runs essentially parallel to the radial line of the handling element 21. Upon counterclockwise rotation of the handling element 21, it is possible—unlike when it is rotated clockwise—to ensure a constant transmission of force. The engagement piece 37 cannot leave the recess 41 upon counterclockwise rotation.

The invention claimed is:

1. A method comprising:

fastening at least one bolt to a diaphragm pump housing of a drive system so that the at least one bolt penetrates a through-hole defined in the diaphragm pump housing, and so that the at least one bolt penetrates a corresponding through-hole of a pressure plate positioned over an outer portion of the diaphragm pump housing, and wherein the at least one bolt has a bearing surface at a second end of the at least one bolt;

positioning a support element of a tightening device over the pressure plate;

fastening the support element of the tightening device to the at least one bolt at the second end;

inserting a screw element having a contact surface into a threaded through hole of the support element; and rotating the screw element within the threaded through hole to cause a change in distance between the contact surface of the screw element and the support surface of the support element, whereby rotating the screw element in one direction causes the contact surface to act on the pressure plate to cause movement of the pressure plate in a direction towards the diaphragm pump along a longitudinal axis of the diaphragm pump, and rotating in an opposite direction causes the contact surface to act on the pressure plate to cause movement in a direction away from the diaphragm pump along the longitudinal axis.

2. The method of claim 1, further comprising, responsive rotating the screw element within the threaded through hole to cause the change in a distance between the contact surface of the screw element and the support surface of the support element, altering a preload on the at least one bolt.

3. The method of claim 1, wherein fastening the support element of the tightening device to the at least one bolt at the second end comprises:

pushing a bayonet-type connection of the support element onto the at least one bolt;

rotating the support relative to the at least one bolt about the longitudinal axis of the diaphragm pump and, thereby, causing the bearing surface of the at least one bolt to engage with the bayonet-type connection of the support element.

4. The method of claim 1, wherein fastening the at least one bolt at one end to the housing of the drive system so that the at least one bolt penetrates the through-hole through the housing of the diaphragm pump comprises:

passing the at least one bolt through the through-hole uncoupled to the through-hole; and threading the at least one bolt into a threaded bore of a chamber section of the drive system.

5. The method of claim 4, further comprising, before threading the at least one bolt into the threaded bore of the chamber section, engaging the diaphragm pump to the drive system chamber section.

6. The method of claim 1, wherein fastening the at least one bolt at one end to the housing of the drive system so that the bolt penetrates the through-hole through the housing of the diaphragm pump, and at the second end to the support element of a tightening device so that the at least one bolt penetrates the pressure plate located between the outer portion of the diaphragm pump housing and the support element comprises engaging the pressure plate to the diaphragm pump.

7. The method of claim 1, wherein fastening the at least one bolt at one end to the housing of the drive system so that the bolt penetrates the through-hole through the housing of the diaphragm pump, and at the second end to the support element of the tightening device so that the at least one bolt penetrates the pressure plate located between the outer portion of the diaphragm pump housing and the support element comprises engaging the support to the pressure plate.

8. The method of claim 7, wherein engaging the support element to the pressure plate comprises mating an inner race groove of the support element to an outer race groove of the pressure plate, the outer race groove on a surface oriented away from the diaphragm pump.

9. The method of claim 7, further comprising coupling the support element to the pressure plate by a plurality of screws.

10. The method of claim 1, further comprising:

rotating a profiled handling element containing the screw element; and responsive to rotating the profiled handling element, rotating the screw element within the threaded through hole to cause the change in a distance between the contact surface of the screw element and the support surface of the support element.

11. The method of claim 10, wherein rotating the screw element within the threaded through hole to cause the change in distance between the contact surface of the screw element and the support surface of the support element, whereby rotating the screw element in one direction causes the contact surface to act on the pressure plate to cause movement of the pressure plate in the direction of the diaphragm pump along the longitudinal axis of the diaphragm pump, the one direction comprising a clockwise direction, comprises:

rotating the screw element in the clockwise direction;

responsive to rotating the screw element, contacting a pressure element to an angled driver surface on an inner surface of a retaining element coupling the screw element within the profiled handling element, the angled driver surface angled with respect to a radial line of the profiled handling element;

applying, by the pressure element, a torque below a threshold torque to the angled driver surface;

responsive applying the torque below the threshold torque to the angled driver surface of the inner surface of the retaining element, moving the contact surface to act on the pressure plate, causing movement of the pressure plate in the direction of the diaphragm pump along the longitudinal axis of the diaphragm pump; and responsive to moving the contact surface to act on the pressure plate, causing movement of the pressure plate in the direction of the diaphragm pump along the longitudinal axis of the diaphragm pump, increasing a compressive force on the at least one bolt.

12. The method of claim 11, further comprising:

applying, by the pressure element, the torque at or above the threshold torque to the angled driver surface; and responsive to applying the torque at or above the threshold torque to the angled driver surface, slipping the pressure element along the angled driver surface.

13. The method of claim 12, further comprising slipping the pressure element along the angled driver surface until the pressure element disengages from a recess of the retaining element, the recess at least partially defined by the angled driver surface.

14. The method of claim 13, further comprising:

responsive to applying the torque at or above the threshold torque to the angled driver surface, compressing a spring of the pressure element; and responsive to compressing the spring of the pressure element, decreasing a height of an engagement piece relative to a top surface of the pressure element.

15. The method of claim 14, further comprising compressing the spring of the pressure element in the radial line.

16. The method of claim 15, wherein rotating the screw element within the threaded through hole to cause the change in distance between the contact surface of the screw element and the support surface of the support element, whereby rotating in an opposite direction causes the contact surface to act on the pressure plate to cause movement in the direction away from the diaphragm pump along longitudinal axis, the one direction comprising a counterclockwise direction, comprises:

rotating the screw element in the counterclockwise direction;

responsive to rotating the screw element, contacting the pressure element to a parallel driver surface on the inner surface of the retaining element coupling the screw element within the handling element, the parallel driver surface parallel with respect to the radial line of the handling element;

applying, by the pressure element, a force to the parallel driver surface;

responsive applying the force to the parallel driver surface on the inner surface of the retaining element, moving the contact surface to act on the pressure plate, causing movement of the pressure plate in the direction of the diaphragm pump along the longitudinal axis of the diaphragm pump; and responsive to moving the contact surface to act on the pressure plate, causing movement of the pressure plate in the direction away from the diaphragm pump along the longitudinal axis of the diaphragm pump, decreasing a compressive force on the at least one bolt.

17. The method of claim 16, wherein decreasing the compressive force on the at least one bolt decreases a force compressing the diaphragm pump to a drive system chamber section.

18. The method of claim 16, wherein movement of the pressure element from the recess is prevented during rotation in the counterclockwise direction by the parallel driver surface.

19. The method of claim 16, wherein rotating the screw element in the counterclockwise direction comprises transmitting a constant force corresponding to the force rotating handling element in the counterclockwise direction to the screw element.

20. The method of claim 16, wherein applying, by the pressure element, the force to the parallel driver surface comprises:

maintaining a length of the spring; and responsive to maintaining the length the spring, maintaining the engagement piece at the same height engaged to the recess.

* * * * *